United States Patent [19]

Hyde et al.

[11] Patent Number: 4,596,233

[45] Date of Patent: Jun. 24, 1986

[54] SOLID FUEL COMBUSTION EQUIPMENT

[75] Inventors: John R. Hyde, Cheltenham; William L. Hackett, Warley, both of England

[73] Assignees: Coal Industry (Patents) Limited; Thorn EMI Energy Developments Limited, both of United Kingdom

[21] Appl. No.: 434,878

[22] Filed: Oct. 18, 1982

[30] Foreign Application Priority Data

Oct. 16, 1981 [GB] United Kingdom ..... 8131280

[51] Int. Cl.[4] ..... F23H 13/06

[52] U.S. Cl. ..... 126/177; 126/152 B; 126/162; 110/300; 122/15

[58] Field of Search ..... 110/248, 255, 281, 293, 110/298, 300, 299; 126/152 R, 152 A, 152 B, 163 R, 181, 242, 162, 171, 162, 177, 168; 277/106; 222/556, 502, 503, 542; 137/601; 251/80, 359; 34/242

[56] References Cited

U.S. PATENT DOCUMENTS

| | | | |
|---|---|---|---|
| 85,470 | 12/1868 | Murray | 126/162 X |
| 605,206 | 6/1898 | Pillatt | 110/298 |
| 639,533 | 12/1899 | Cragin | 110/248 X |
| 742,750 | 10/1903 | Stephenson | 277/106 |
| 808,523 | 12/1905 | Engel | 126/177 |
| 890,252 | 6/1908 | Thompson | 34/242 |
| 1,064,904 | 6/1913 | Havard | 126/177 |
| 1,586,838 | 6/1926 | Perrey | 126/163 R X |
| 2,070,349 | 2/1937 | Woodruff | 222/502 |
| 2,377,209 | 5/1945 | Carroll | 126/162 X |
| 2,977,106 | 3/1961 | Duff | 34/242 X |
| 3,547,152 | 12/1970 | Hess | 137/601 |
| 4,294,283 | 10/1981 | Scharres | 137/601 |
| 4,320,710 | 3/1982 | Steiner et al. | 110/255 X |

FOREIGN PATENT DOCUMENTS

| | | | |
|---|---|---|---|
| 169580 | 4/1906 | Fed. Rep. of Germany | 110/298 |
| 631003 | 6/1936 | Fed. Rep. of Germany | 126/162 |
| 2714600 | 10/1978 | Fed. Rep. of Germany | 110/281 |
| 8103374 | 11/1981 | PCT Int'l Appl. . | |
| 334757 | 9/1930 | United Kingdom . | |
| 1065325 | 9/1965 | United Kingdom | 251/359 |
| 1189290 | 4/1970 | United Kingdom | 126/181 |

*Primary Examiner*—James C. Yeung
*Assistant Examiner*—Allen J. Flanigan
*Attorney, Agent, or Firm*—Stevens, Davis, Miller & Mosher

[57] ABSTRACT

Solid fuel combustion equipment in the form of a grate assembly comprises longitudinally extending support elements on which are mounted laterally orientated grate bars. The support elements are pivotable about their horizontal axes and are provided with sealing means at their adjacent margins to effect a seal to prevent in use passage of air when the elements are horizontally aligned. De-ashing of the grate assembly in use is achieved by tipping the support elements, whereupon ash falls to a receiving area when it is removed.

17 Claims, 8 Drawing Figures

SOLID FUEL COMBUSTION EQUIPMENT

This invention concerns improvements in or relating to solid fuel combustion equipment.

In particular, the invention has reference to such equipment intended for use in boilers or furnaces.

Conventionally, there are various types of combustion equipment employed in industrial boilers and furnaces, for example the travelling grate stoker or the underfeed stoker both of which have wide application but possess inherent disadvantages by the very nature of their mode of operation. In this connection, both require moving parts in order to function and these being subject to an elevated temperature environment are also subject to corrosion, erosion, stressing and consequent malfunction, thus necessitating replacement at what is generally a high cost. The maintenance, therefore, attaching to equipment of these types can be frequent, time consuming and expensive with the concomitant disadvantage of protracted down-time for the furnace or boiler in which the equipment is installed.

A further problem associated with conventional equipment of the kind referred to is that of ash removal from the combustion zone and more particularly from the mechanism on which the fuel is actually burnt. It can be and very often is the case that clinkering occurs thereby inhibiting both clean and swift ash removal and the continuing combustion process itself. Again, this can have a substantial and serious effect upon the plant relying on the combustion equipment by way of interruption in operation.

Attempts have been made to improve upon existing designs of equipment and many years ago it was proposed to utilize a grate comprising unitary grate bars transversely disposed in relation to the length of the boiler or furnace in which the grate was to be installed, the bars being so mounted as to be tiltable thereby in use enabling the gravitational discharge of ash or other material lying on their upper surfaces into a receiving area beneath the grate. A problem associated with this early proposal was that of ensuring that the requisite combustion air passed through the perforated grate bars and did not escape through the interstices therebetween, thereby occasioning imbalanced combustion conditions and the undesirable formation of clinker.

An object of the present invention is to provide improved solid fuel combustion equipment possessing features which overcome or reduce the problems attendant upon known equipment.

According to one aspect of the invention there is provided solid fuel combustion equipment including a grate assembly having at least two longitudinally extending support elements adapted to pivot about the longitudinal axes thereof, a plurality of grate bars arranged on the support elements, and sealing means associated with each support element and cooperable to provide a seal between the elements.

More than two support elements may be provided, for example four. Conveniently the support elements of the grate assembly may be of box section and in the form of a four sided frame, the grate bars being supported thereon and registering positively therewith in order to be retained during the movement of the elements in use. The grate bars may for example be retained on the support elements by bolt arrangements.

The support elements are advantageously provided with a stub shaft at each end thereof, the stub shaft being connectible to an actuating mechanism associated with the grate assembly and adapted in use to pivot the support elements. The support elements being of box section and therefore hollow may provide a flow path for a coolant, for example water, which is pumped therethrough during use to maintain the temperature thereof at an acceptable level. In the preferred arrangement, the flow paths are constituted within the longitudinal side members of the four sided frame, there being provided a cross-connection between the two side members for the passage of coolant from one side member to the other. A shaft at one end of the support element is provided with supply and return passages for the coolant having appropriate input and output connections. Piping from the supply and return passage affords a means of carrying coolant flow to and from the flow paths in the side members of the support elements.

The sealing means are preferably attachable to the support elements either on a side thereof or depending therefrom, provided that when in use the support elements are in a horizontal or substantially horizontal position, the sealing means cooperate to give a seal between the adjacent support elements to prevent the passage of air or other gas.

The sealing means are preferably attachable to the support elements through the agency of a resilient mounting which confers upon the sealing means a self-compensating feature for any deviation or relative movement as between the support elements or because of contamination of the sealing areas of the sealing means. The method of attachment may comprise a nut and bolt assembly incorporating a spring or equivalent, for example a block of elastomeric material capable of withstanding the high temperature environment in which the resilient mounting has to operate in practice.

The sealing surfaces of the cooperating sealing means may, in one alternative embodiment, be arcuate and this form is of particular advantage when the support elements come together pivotally in opposite senses, i.e., clockwise and anti-clockwise, the curved surfaces affording a positive and effective rolling and sealing contact. The arcuate surfaces may conveniently be part of the circumferential surface of a tubular member extending longitudinally of the support element and having an appropriate mounting arm for attachment to the element through the agency of the aforesaid resilient mounting. In an alternative, the tubular members may be replaced by rollers.

In another alternative, the sealing surfaces of the cooperating sealing means may be linear, one being constituted by a straight edge and the other by a flat or substantially flat surface, either one or both being resiliently mounted. An alternative to the straight edge for one of the sealing surfaces may be hemispherical or any arcuate form cooperable with the flat or substantially flat cooperable sealing surface.

According to a second aspect of the invention, there is provided a boiler having a combustion chamber in which is mounted solid fuel combustion equipment according to the first aspect of the invention.

The wall of the combustion chamber preferably has sealing means cooperable with those of the support element disposed adjacent thereto.

By way of example only, one embodiment of solid fuel combustion equipment according to the invention is described below with reference to the accompanying drawings in which.

Figure 1:
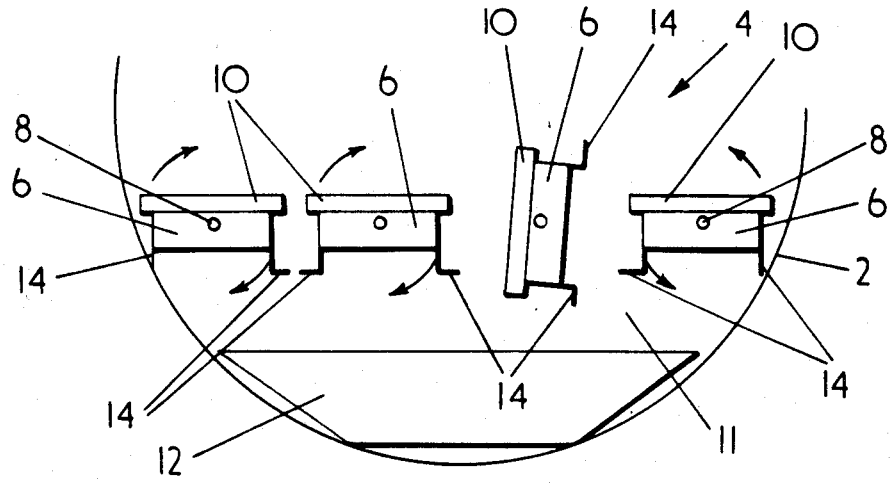
FIG. 1 is a diagrammatic cross-section of a boiler combustion chamber with the solid fuel combustion equipment mounted therein.
Figure 2:
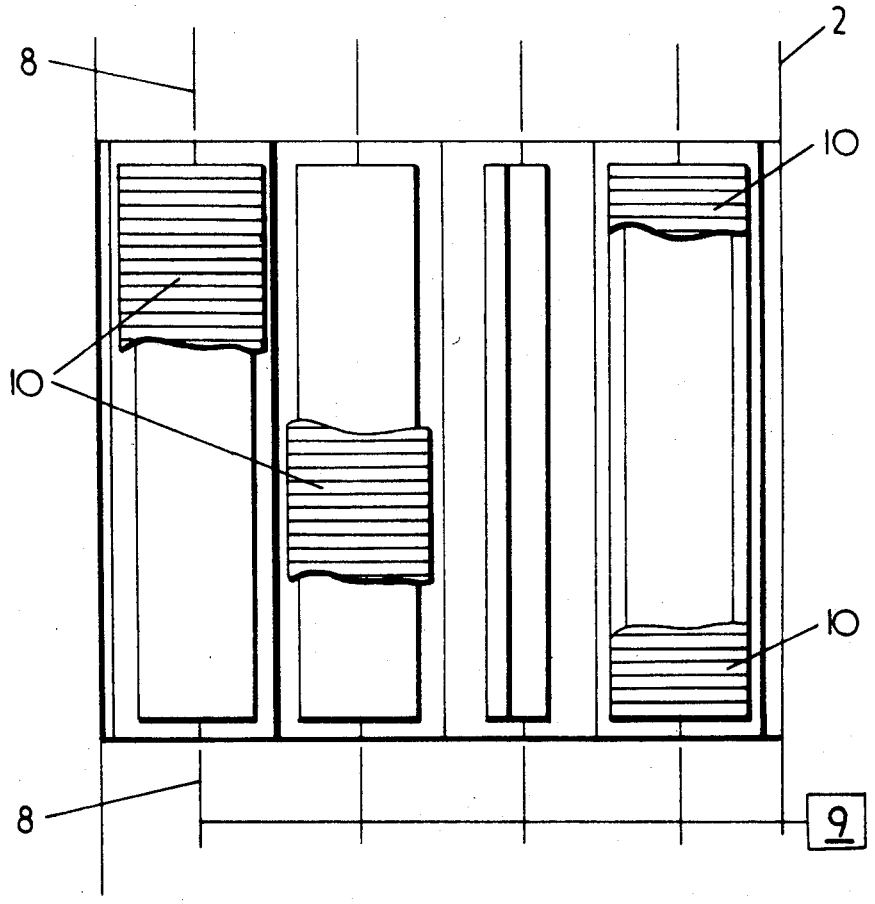
FIG. 2 is a diagrammatic plan of the view shown in FIG. 1.

Referring first to FIGS. 1 and 2, there is depicted a boiler combustion chamber 2 having disposed therein solid fuel combustion equipment in the form of a grate assembly including a grate 4 provided with four support elements 6 extending longitudinally of the chamber. Each support element 6 has a shaft 8 at each end thereof to enable pivotal movement of the element caused by an actuating mechanism 9. The actuating mechanism may be in the form of fluid operable cylinders, that is pneumatic or hydraulic, controlled either manually or automatically. Each support element 6 is of box-section and is in the form of a four sided frame with which a plurality of transverse grate bars 10 registers in closely packed array, the bars 10 being secured to the element 6 by means of bolting arrangements (not shown).

Located beneath the grate 4 is an ash removal device shown diagrammatically at 12 which may be a vibratory extractor or a screw conveyor or any suitable device for effecting ash discharge from the area 11 beneath the grate 4.

Each support element 6 has provided along its length sealing means 14 for cooperation with such means on an adjacent element or on the wall of the combustion chamber 2.

Figure 3:
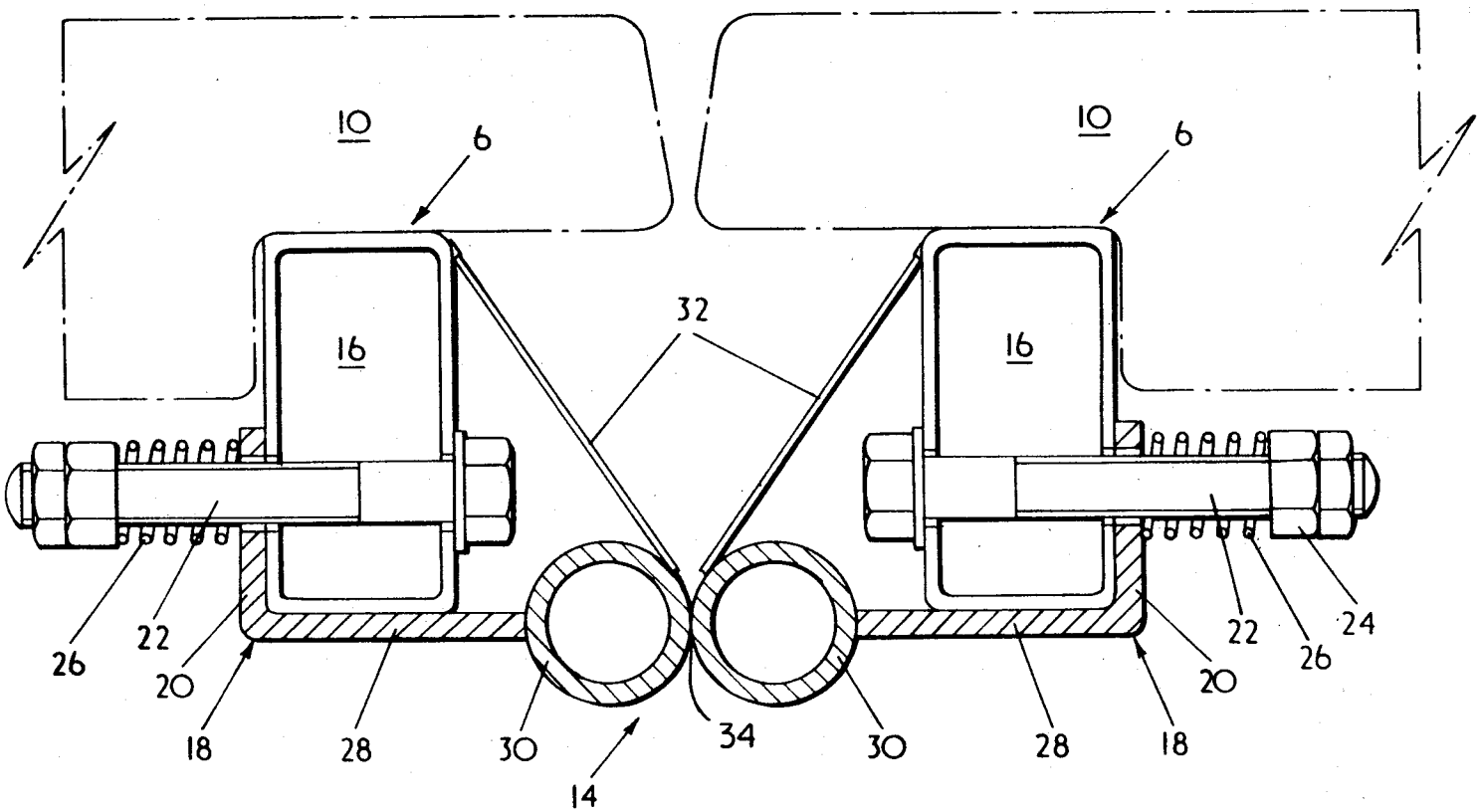
FIG. 3 is a cross-section of a first detail of solid fuel combustion equipment diagrammatically illustrated in FIGS. 1 and 2.

Referring now to FIG. 3, there is illustrated a form of sealing means 14 employed for the adjacent two middle elements 6. As will be seen the box section sides 16 of the elements 6 are shown and to these sides are affixed the sealing means 14 of which each comprises an angle iron 18 the shorter limb 20 of which is drilled to receive a fixing bolt 22 which passes through the side 16 and is secured by a nut 24, an open coil compression spring 26 being interposed between the nut 24 and the limb 20. The longer limb 28 carries a tubular member 30 along its longitudinal edge and a shield plate 32 extends in sloping fashion from the upper part of the side 16 to the top region of the tubular member 30. As can be seen the elements 6 are in a horizontal position and the arcuate sealing surfaces 34 are in contact with one another to seal the space between the two adjacent middle elements 6. The arcuate sealing surfaces 34 for those two centre elements 6 were chosen because in operation, the elements when pivoted, move in opposite directions and the curved nature of the surfaces affords a rolling contact effective for the purpose of sealing.

Figure 4:
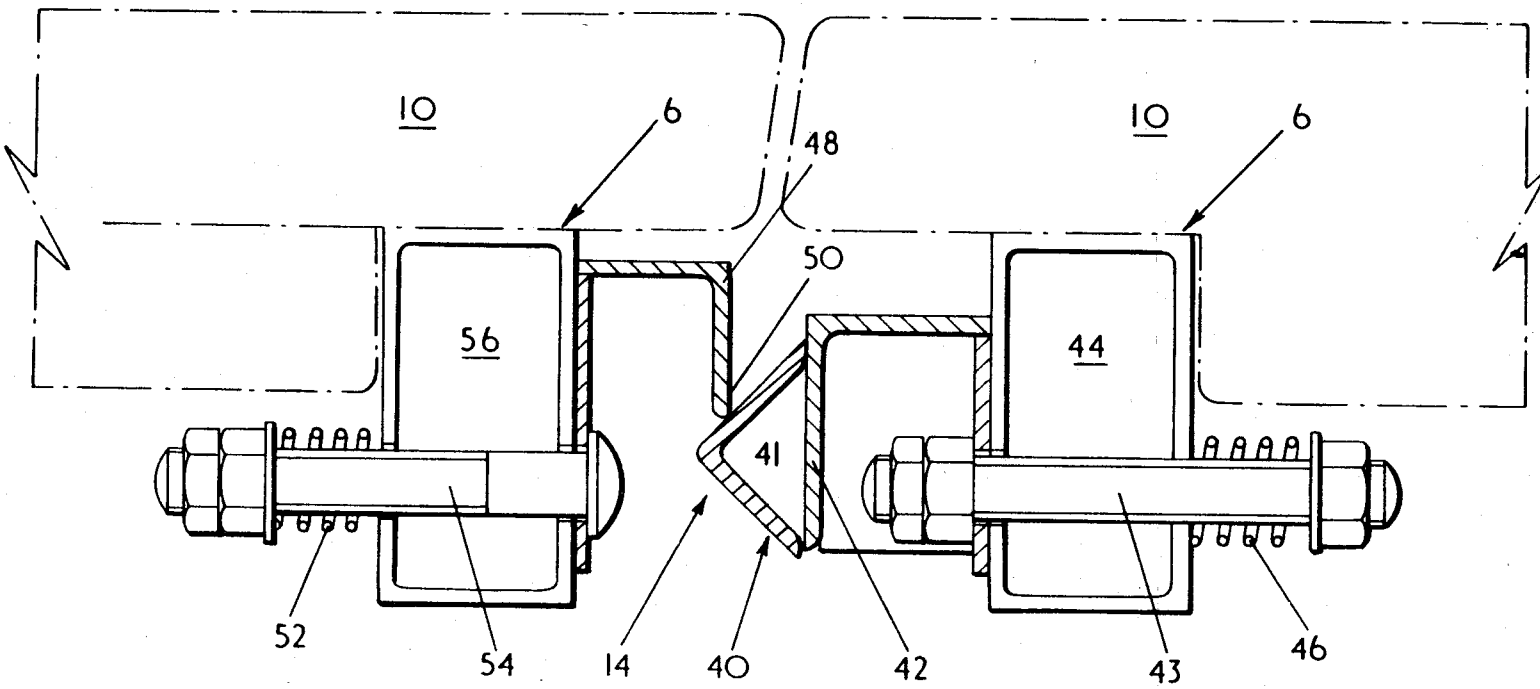
FIG. 4 is a cross-section of a second detail of such equipment.

Referring now to FIG. 4, the sealing means 14 employed between the adjacent sides of the middle elements 6 and the outer elements 6 are shown, the sealing means 14 on one element being different from but cooperable with that of the other elements. As viewed in FIG. 4, the right-hand sealing means 14 is constituted by an angle iron 40 secured to an inverted U-shaped channel 42 secured by a bolt 43 to the box-section side 44 of one element 6, an open coil compression spring 46 being interposed between the head of the bolt and the side 44.

The left-hand sealing means 14 of FIG. 4 comprises an inverted U-shaped channel 48, one side of which terminates in a straight edge 50 which is sealingly cooperable with the flat surface presented by an abutment in the form of one limb 41 of the angle iron 40. The U-shaped channel 48 is also resiliently mounted to the box-section side 56 of an adjacent element 6 through the agency of a spring 52 through which extends a securing bolt 54.

Figure 5:
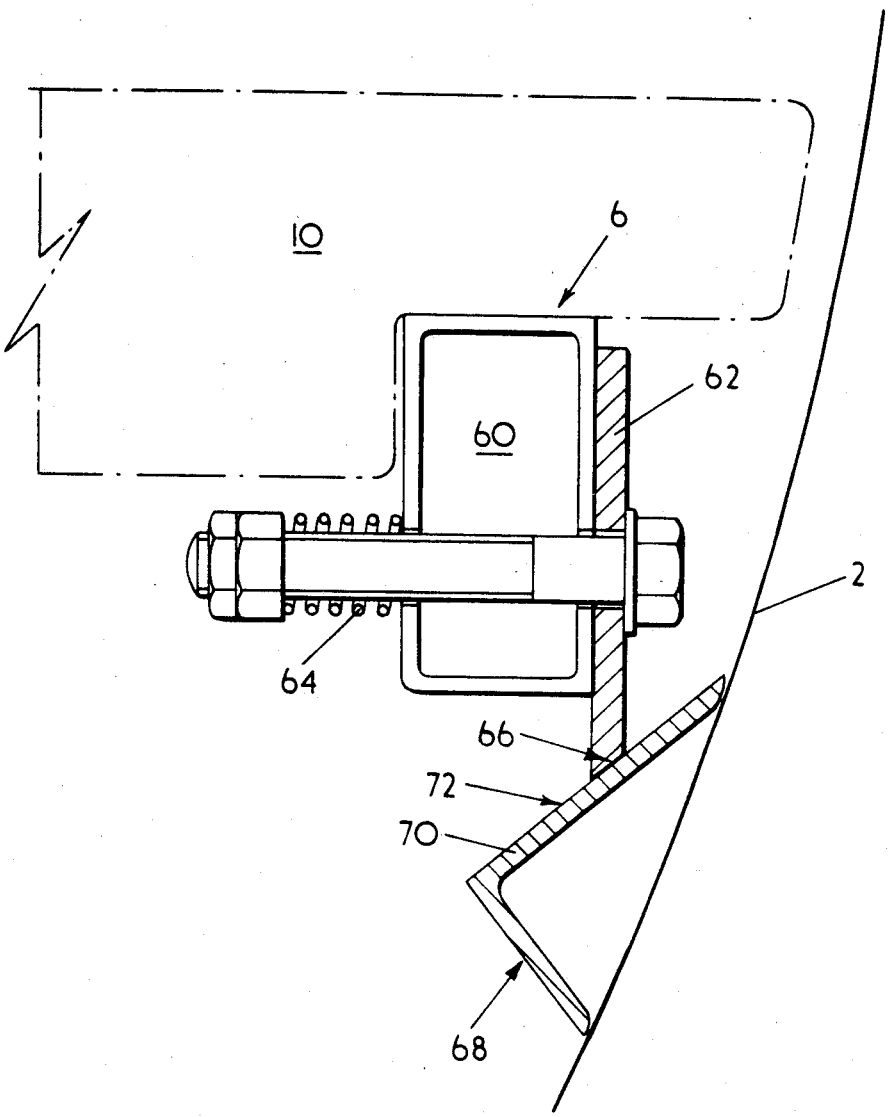
FIG. 5 is a cross-section of a third detail of such equipment.

Referring now to FIG. 5, the sealing means 14 employed as between the outer side of the outer elements 6 and the wall of the combustion chamber 2 are shown. At this location, the box-section side 60 of each outer element 6 carries a plate 62 bolted thereto and resiliently mounted by means of a spring 64, the plate 62 having a sealing edge 66. An angle iron 68 is secured, by for example, welding to the wall of the combustion chamber 2 and one limb 70 thereof presents a flat sealing surface 72 with which the edge 66 cooperates to form a seal.

Each support element 6 thus has two sealing means one at each longitudinal margin for the purpose of cooperating with the complementary sealing means of an adjacent support element 6 to prevent in use passage of air therebetween. As can be seen in FIGS. 3, 4 and 5 the mating surfaces, whether or curved or linear form afford the necessary seal when the support elements 6 and thus the grate bars 10 are in a horizontal position. It is important to ensure that combustion air does not escape between adjacent elements but merely passes through the grate bars 10 and the fuel bed which in use is supported thereby. If such a sealing arrangement were not provided, clinkering and subsequent fouling of the grate bars would occur thereby giving rise to discontinuous operation with frequent shut-down periods.

Figure 6:
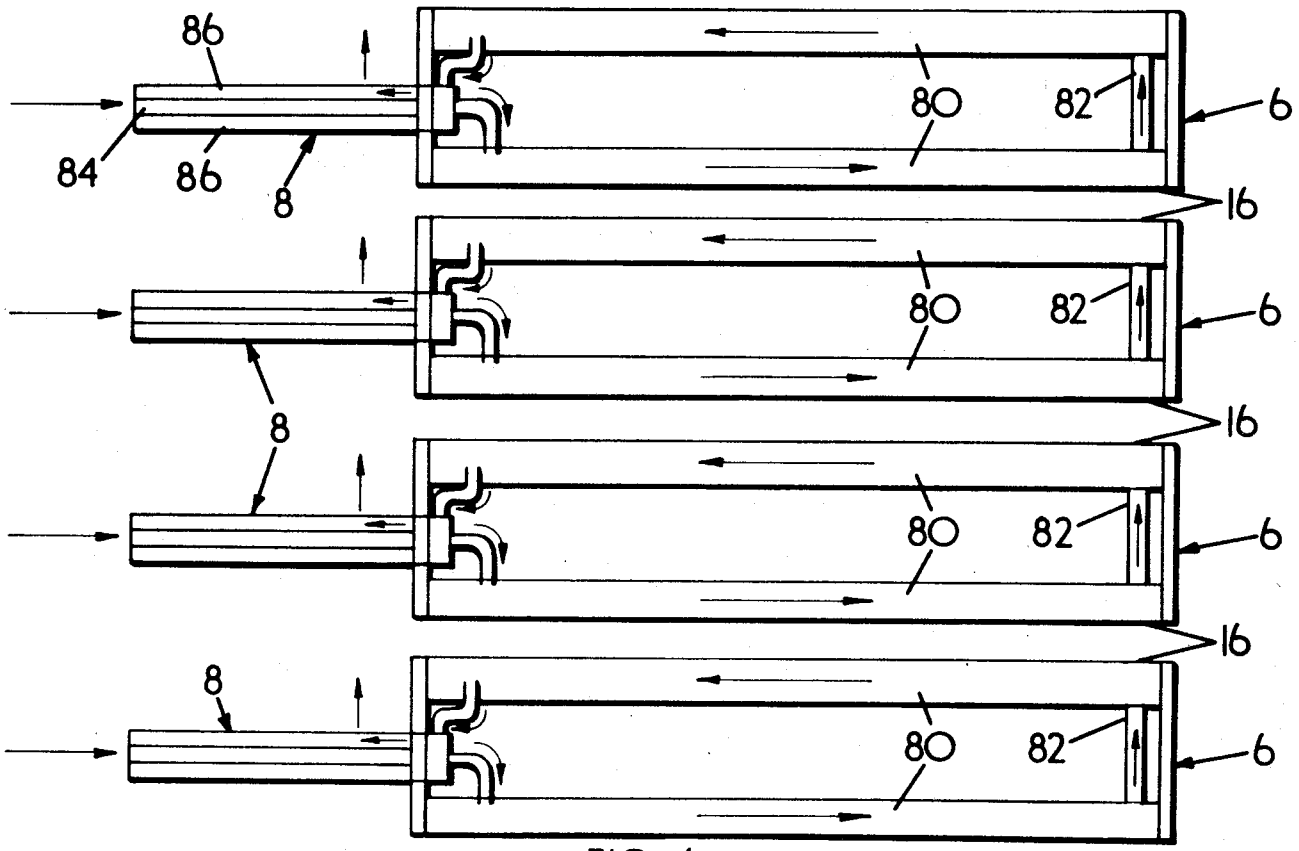
FIG. 6 is a diagrammatic plan view of solid fuel combustion equipment showing cooling arrangements therefor.
Figure 7:
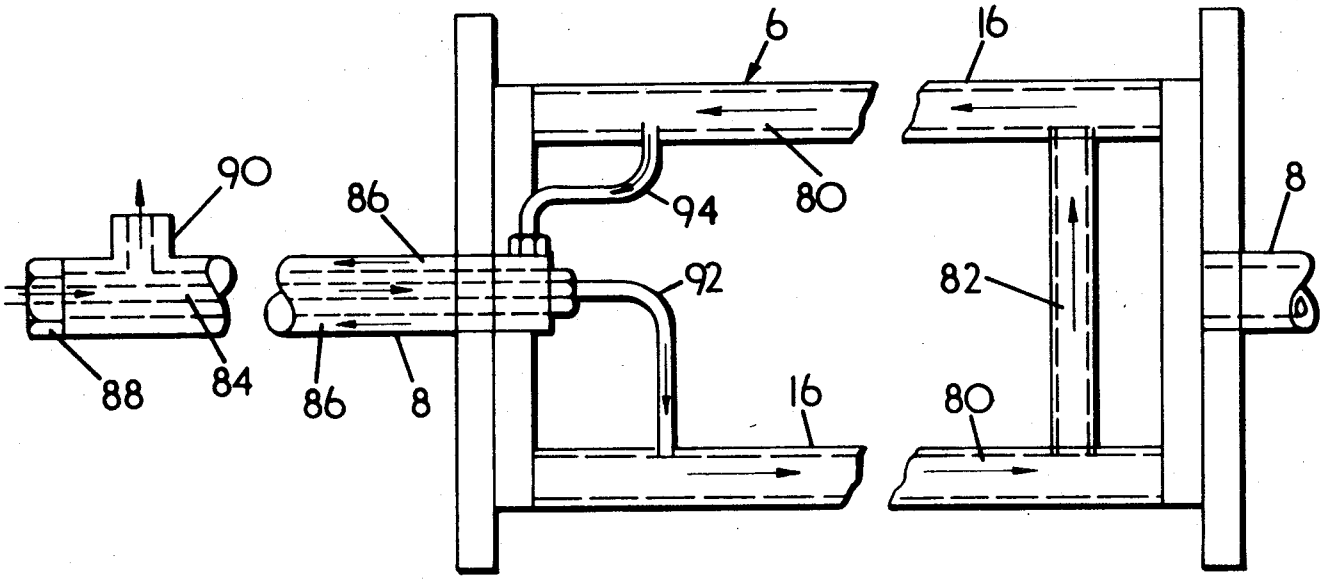
FIG. 7 is a diagrammatic plan view of one of the support elements illustrated in FIG. 6.
Figure 8:
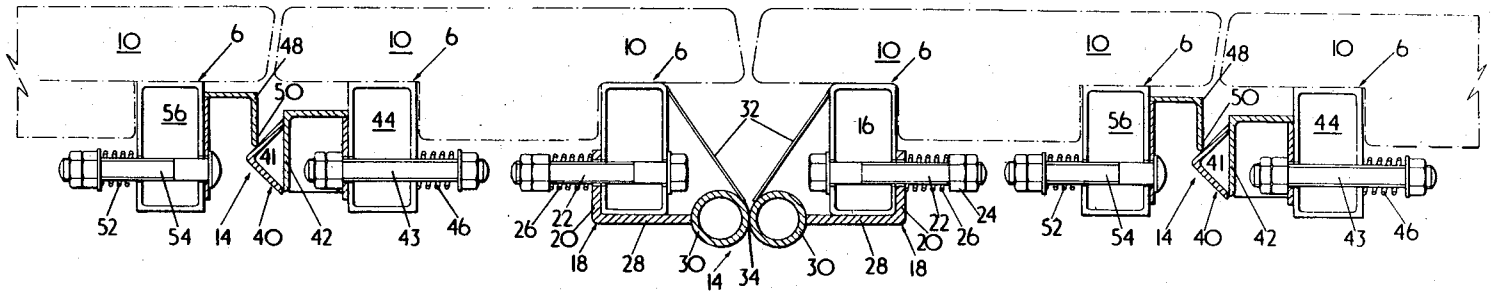
FIG. 8 is a cross section showing the entire grate as partially shown in FIGS. 3 and 4.

Referring now to FIGS. 6 and 7, the support elements 6 have cooling paths 80 in the side members 16 and a cross-duct 82 extends therebetween for the flow of coolant from one side member to the other. The stub shaft 8 at one end of each support element 6 is drilled to provide a central supply passage 84 and two return passages 86, an input connection 88 being arranged at the end of the shaft 8 and an output connection 90 at a point intermediate the ends of the shaft 8. Pipe 92 connects the supply passage 84 to the relatively lower side member 16 and pipe 94 connects the return passages 86 to the relatively upper side member 16 as viewed in the drawings.

In operation, when it is desired to de-ash the grate 4, the support elements 6 are pivoted in turn and as shown by the arrows in FIG. 1, the left-hand pair of elements 6 move clockwise in order to discharge ash into the sub-grate area 11 and the right-hand pair moves anticlockwise. The elements 6 may,in use, be pivoted sequentially in a timed manner and automatically or may be pivoted as required upon inspection of the combustion conditions obtaining on the grate 4. During the pivotting or tipping operation when ash is being discharged from the grate 4 and 'dumped' into the area 11, the air supply to the combustion chamber 2 may be momentarily stopped. One advantage of the present invention is that the removal of ash from the grate 4 is swift, thus resulting in little if any interruption in the operation of the boiler or furnace in which the combustion equipment is installed. The frequency with which the elements 6 are in use actuated to pivot and discharge ash will depend upon the nature and quality of the ash. The support elements 6 are caused to reassume their horizontal positions and advantageously are brought together sharply whereby the complementary sealing means positively engage, indeed impact against one another thereby to ensure not only that effective sealing is achieved but also occasion the removal from the sealing surfaces of any particles which may have adhered thereto. In coming together, the resilient mountings in the form of springs afford a degree of flexibility to compensate for any variations in the orientation of the elements or wear or the equivalent.

During operation of the equipment a coolant, for example water, is passed through the cooling paths 80 in the side members 16 of the support elements 6 or order to maintain the temperature of the support elements at an acceptable level.

The whole or any part of the operation of the grate 4 whereby ash removal is achieved can be automatically controlled with the minimum effect on the operation of the boiler or furnace. A further advantage of the present invention lies not only in its inherent capabilities and intended operation but also in its ability to be used as a static grate, should there be any failure, for example in the actuating mechanism for pivotting the elements. The likelihood of such an occurence is remote since there are so few moving parts; however, the supporting elements 6 and the grate bars 10 can be locked in their horizontal positions and removal of ash therefrom is achieved manually.

In boilers incorporating the equipment of the present invention, it is used to clean the exhaust gases and this is achieved by the use of grit arrestors which separate the particulates from the entraining combustion gases. Since the particulates often contain unburnt carbon, they are refined, that is introduced to the combustion chamber wherein they are afforded a further opportunity to burn. Unfortunately because of their size, the residence time tends to be small and thus combustion of refined particulates is not assured. With the present invention, tilting of the grate elements occasions the discharge not only of ash but also some burning fuel, the heat of which is transferred to the surrounding water jacket in the under grate region. Once the grate elements are returned to their normal horizontal position, air still passes upwardly through the grate bars, the air being fed from the region beneath the grate. Accordingly, the present invention allows of the opportunity to refine the particulates seperated from the exhaust gases into the region beneath the grate wherein they can undergo further combustion with an enhanced residence time since they cannot escape with the combustion gases. At the same time the heat generated by virtue of the combustion is given up to the water surrounding the region beneath the grate.

The present invention thus couples simplicity with reliability in realizing a practical and innovative way of facilitating ash removal from grates, while maintaining efficient and substantially continuous operation.

We claim:

1. Solid fuel combustion equipment including a grate assembly having at least two longitudinally extending support elements adapted to pivot about the longitudinal axes thereof, a plurality of grate bars arranged on the support elements, and sealing means attachable to each longitudinal side of each support element such that in use when the support elements are in a horizontal position, the sealing means cooperate to provide a resilient seal between adjacent support elements to prevent the passage of gas.

2. Equipment according to claim 1, in which four support elements are provided in the grate assembly.

3. Equipment according to claim 1, in which the support elements are of box section.

4. Equipment according to claim 1 in which each support element is in the form of a four sided frame, the grate bars being supported thereon and registering therewith.

5. Equipment according to claim 4, in which the grate bars are arranged transversely of the support elements.

6. Equipment according to claim 1, in which each support element is provided with a shaft at each end thereof.

7. Equipment according to claim 6, in which at least one of the shafts of each support element is connectible to an actuating mechanism associated with the grate assembly and adapted in use to pivot the support elements.

8. Equipment according to claim 1, in which the sealing means are attachable to each support element by means of a resilient mounting.

9. Equipment according to claim 8, in which the resilient mounting includes a spring.

10. Equipment according to claim 1, in which cooperating sealing means of adjacent support elements have sealing surfaces.

11. Equipment according to claim 10, in which the sealing surfaces are arcuate.

12. Equipment according to claim 10, in which the sealing surfaces are linear.

13. Equipment according to claim 12, in which one of the linear surfaces is constituted by a straight edge and the other by a flat surface.

14. Equipment according to claim 1, in which the support elements are provided with flow paths for the passage of a coolant.

15. Solid fuel combustion equipment including a grate assembly having four longitudinally extending support elements arranged side by side and adapted to pivot about the longitudinal axes thereof, first sealing means on adjacent parts of the two centre support elements comprising tubular members resiliently mounted on the support elements and adapted to abut and seal the two centre support elements, and second sealing means on adjacent parts of the two centre support elements and the two side support elements, the second sealing means comprising a plate member resiliently mounted on one support element and a resiliently mounted abutment on the other support element presenting a flat surface to complement and seal with the plate member.

16. A boiler including a combustion chamber, side sealing means provided on the wall of the combustion chamber and solid fuel combustion equipment according to claim 1, the side sealing means of the combustion chamber being cooperable with sealing means provided on the outer margins of the outer support elements of the grate assembly.

17. Solid fuel combustion equipment including a grate assembly having at least two longitudinally extending support elements adapted to pivot about the longitudinal axes thereof, a plurality of grate bars arranged on the support elements, and sealing means attributable to each longitudinal side of each support element such that in use when the support elements are in a horizontal position, the sealing means cooperate to provide a seal between adjacent support elements to prevent the passage of gas, the sealing means comprising tubular members a part of the cirfcumferential surface of which presents arcuate sealing surfaces, the tubular members having mounting arms for attachment to the support elements.

* * * * *